United States Patent [19]

Bass

[11] Patent Number: 5,009,414

[45] Date of Patent: Apr. 23, 1991

[54] EXERCISE SHIELD DEVICE, DIAGNOSTIC TOOL

[76] Inventor: Eric Bass, 10 Walton Ave., Doylestown, Pa. 18901

[21] Appl. No.: 510,922

[22] Filed: Apr. 19, 1990

[51] Int. Cl.[5] ..... A63B 69/34; A63B 69/00

[52] U.S. Cl. ..... 272/76; 2/2; 128/869; 273/55 R; 273/55 A

[58] Field of Search ..... 128/846, 869; 182/137, 182/139; 2/2; D21/198, 199; 272/93, 76, 77, 78, 126, 902; 273/55 R, 55 A

[56] References Cited

U.S. PATENT DOCUMENTS

| | | | |
|---|---|---|---|
| 2,526,217 | 10/1950 | Gilman | 272/76 |
| 2,756,429 | 7/1956 | Malachowski | 2/2 |
| 3,476,107 | 11/1969 | Matt, Jr. et al. | 128/869 |

FOREIGN PATENT DOCUMENTS

| | | | |
|---|---|---|---|
| 3401111 | 7/1985 | Fed. Rep. of Germany | 2/2 |
| 18670 | of 1911 | United Kingdom | 272/77 |

*Primary Examiner*—Richard J. Apley
*Assistant Examiner*—Karen G. Horowitz
*Attorney, Agent, or Firm*—Caesar, Rivise, Bernstein, Cohen & Pokotilow, Ltd.

[57] ABSTRACT

An exercise, diagnostic and training device and method for football players, sports players and the general public, comprising a generally elliptically-shaped peripheral member, a first support member, a second support member, a gripping member, and a plurality of body engagement ribs, all generally cylindrical in cross-section and having protective cushioning. The peripheral member encloses and is fixedly secured to the ends of the first and second support members, the axes of which are generally perpendicular. The gripping member comprises a set of handles and a separator plate on each side of the shield which are supported by the first support member. The plurality of generally horizontal body engagement ribs are supported by the second support member and provide cushioning and protection against injury for opposing players on each side of the shield.

20 Claims, 3 Drawing Sheets

EXERCISE SHIELD DEVICE, DIAGNOSTIC TOOL

BACKGROUND OF THE INVENTION

This invention relates generally to exercise devices and more specifically to exercise devices to be used by one or more persons as a game of physical ability and as a training and diagnostic device for football and other sports.

Prior art exercise and/or training devices have attempted to provide diagnostic and training assistance to players and coaches but have suffered from numerous drawbacks. Most notably, previous devices were deficient because they were extremely bulky and heavy and therefore difficult to transport and store when not in use. Also due to their size and the concomitant expense in designing and building them, prior art devices were not sufficiently available to professional and amateur players, teams and the general public, when these individuals wished to practice skills and/or play a game at home, or at times other than during team practice sessions.

Samples of prior art devices for training football and other sports players, are found in U.S. Pat. Nos. 4,736,947 (Jenkins), 4,067,571 (Rogers), 4,828,252 (Bowen), and 4,565,367 (Kaiser).

The device of the present invention constitutes a shield with special features which overcomes the disadvantages of the prior art by providing professional and amateur sports players, especially football players, with a means to practice their skills without having to transport and wear bulky, protective football equipment. The exercise shield provides users with a means to increase their football blocking, pass rushing and other skills by functioning as a diagnostic tool and as a training apparatus. The exercise shield permits users to improve vital sporting skills by allowing them the flexibility and challenge to practice one-on-one or during an organized group practice without using bulky football or other sporting protective pads and equipment. In particular, the shield includes a pair of handles on each side of the shield or barrier wall. The user grasps the handles and can then practice his/her skills alone or by exerting force against a second opposing player grasping the second set of handles on the reverse side of the shield.

As a diagnostic tool, the exercise shield enables a coach/trainer or an individual player to diagnose certain elements of the player's blocking/pass rushing proficiencies and/or weaknesses. These elements include physiological factors, such as leg strength, speed, balance and coordination, along with arm strength and overall body power, as well as those related to technique. This diagnostic capability allows coaches to objectively measure a player's strengths and/or weaknesses, and aids in determining the appropriate team positions a player should play by facilitating the screening and selection of potential player candidates.

The device also permits off-season and in-season practice to become more focused and results-oriented, by providing players with continuous feedback on performance and improvement. Players using the device may also focus their efforts on particular techniques without the need of protective equipment.

In addition to diagnosing a player's pass blocking and rushing, drive blocking and run defense strengths and weaknesses, the device improves a player's offensive and defensive skills employed while playing interior team football positions. It is vital that these skills be mastered because football played in North America emphasizes blocking and defensive line skills. Experts generally agree that these motor skills include leg and foot speed, balance, technique, upper body strength, speed of recognition/reaction time, and hand-eye coordination, along with intelligence. Research demonstrates that these motor skills are improved through training which can now be performed year round for even more substantial improvement. Saccadic eye movements, head movements, and peripheral vision are also necessary for good offensive and defensive playing. The device of the present invention also accelerates the development of effective saccadic eye movement skills because its design enables the player to see beyond his opponent on the other side of the shield and direct his efforts toward a chosen goal. The player is then required to change direction and attempt to either move his opponent or maneuver around him according to what he sees.

The device may be used to train peripheral awareness as well, using two techniques. The first technique requires the player to run parallel and locate and move towards a goal by releasing or forcing toward the goal (i.e., scrambling quarterback or running back). By varying the angular distance between the player and the selected target, the coach/trainer can increase the angles and then can see where a player's response movements are dependable and strongest. The device used in this mode allows the coach to diagnose weaknesses in recognition and movements to the target (ball carrier, etc.). The device also effectively trains a player's eyes by permitting the player to vary the direction from which he moves, either from the right or left, along with body movement, and reaction time.

In the second technique, a player's peripheral awareness and hand-eye coordination are trained by stationing the player sufficiently close to the device to have its ends in his peripheral field of vision. The player is then required to indicate which end of the device is touched by his opposing partner by tapping the end that is selectively tapped b his opposing partner.

Improving these skills not only enhances a player's blocking and pass rushing abilities, but also increases a player's field awareness. Field awareness is a vital element in a player's overall playing proficiency and includes awareness of both the opposition's movement and that of other players on the field.

OBJECTS OF THE INVENTION

Accordingly, it is a general object of this invention to provide a device which provides amateur and professional football players with a means to practice and improve their blocking and pass rush skills without having to wear protective football equipment.

It is a further object of this invention to provide a device which enables its users to develop athletic skills while minimizing their chances of being injured or causing damage to their surroundings.

It is yet still a further object of this invention to provide a compact device which may be used in confined indoor spaces as well as outdoors.

It is a further object of this invention to provide a device which facilitates diagnosis of a person's physical proficiencies and weaknesses.

It is yet a further object of this invention to provide a device which permits the general public to play a game of physical ability.

SUMMARY OF THE INVENTION

These and other objects of this invention are achieved by providing an exercise device for diagnosis and training of football and other sports players and for use in the methods of this invention, comprising a generally peripheral member having a first support means, a second support means, a gripping means, and a plurality of body engagement ribs, all generally cylindrical in cross-section and having protective cushioning. In one preferred embodiment, the peripheral member is elliptically shaped, while in the second preferred embodiment, the peripheral member is circular. The peripheral member encloses and is fixedly secured to the ends of the first and second support means, the axes of which are generally perpendicular. The gripping means comprises a set of handles and a separator plate on each side of the shield which are supported by the first support means. The plurality of the generally horizontal body engagement ribs are supported by the second support means and provide cushioning and protection against injury for opposing players on each side of the shield.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
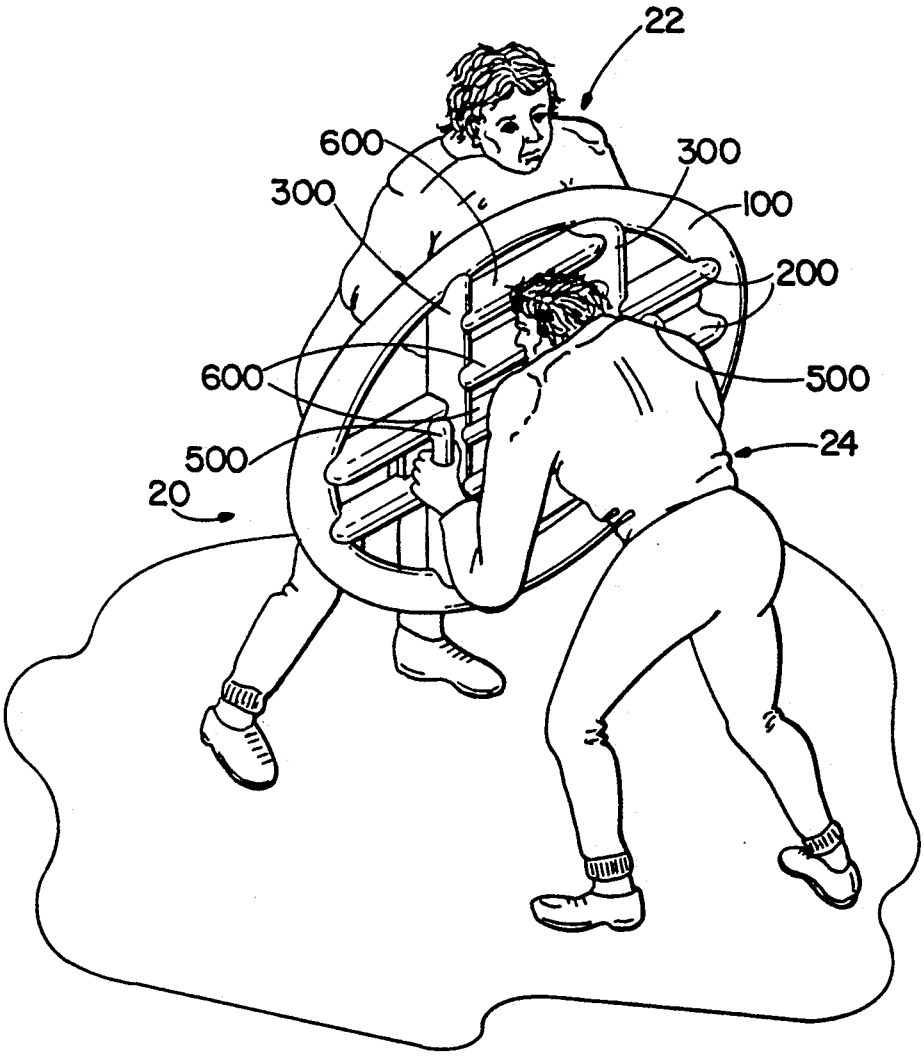
FIG. 1 is an isometric view of the device of the present invention being used by two opposing players.

Referring now to various figures of the drawings where like reference numerals refer to like parts there is shown at 20 in FIG. 1 a device constructed in accordance with the present invention. The device 20 comprises a shield-like structure which is arranged to be used by two players 22 and 24 or by a player and a coach or by any two participants.

As can be seen from the first embodiment, the shield like structure is made up of a generally elliptically-shaped peripheral member 100, a pair of latitudinal first support members 200, a pair of longitudinal second support members 300, a pair of gripping handles 500 on each side of the device 20, and a plurality of body engagement ribs 600. The various members are all generally cylindrical in cross-section and are protectively cushioned.

Figure 2:
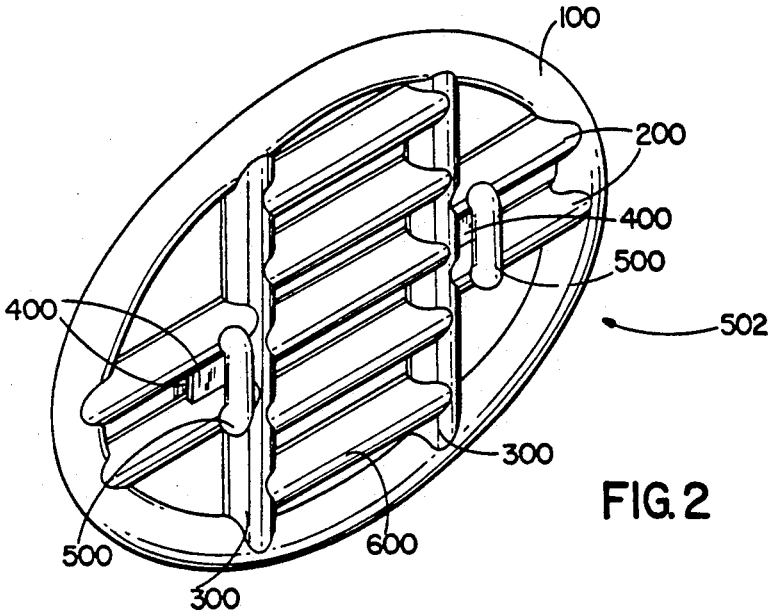
FIG. 2 is an isometric view of the rear side of the device shown in FIG. 1.
Figure 3:
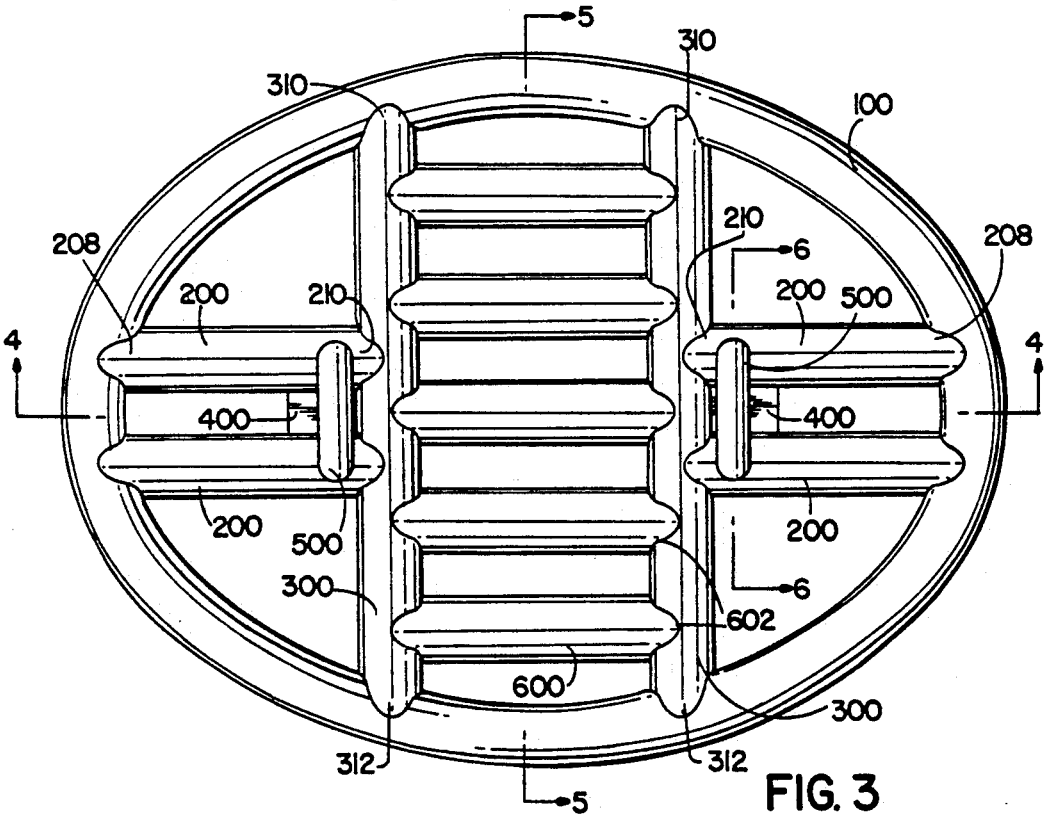
FIG. 3 is an enlarged front view of the device shown in FIG. 1.

As shown clearly in FIGS. 2 and 3 the peripheral member 100 encloses and is fixedly secured to the ends of the first support members 200 and the ends of the second support members 300, with the longitudinal axes of members 200 and 300 being oriented generally perpendicular. The gripping handles 500 are secured to the device by finger separator 400 plates on each side of the shield which are supported by the first support members 200. The plurality of the horizontal body engagement ribs 600 are spaced a distance apart and are supported by the second support members 300 to provide cushioning and protection against injury for players on opposing sides of the shield.

Although the first preferred embodiment of the device is elliptically-shaped to minimize potential corners or edges which could injure players, it should be readily apparent to those skilled in the art that the device may formed in any geometric shape. In order to reduce manufacturing costs, for example, the device may be made circular in shape (not shown). Likewise, the use of members generally cylindrical in cross-section is preferred to minimize potential injury to players upon body impact with the device and to decrease manufacturing costs. However, it should be readily apparent that any similar cross-sectional structure may be utilized depending upon the circumstances of use and manufacture.

Figure 4:
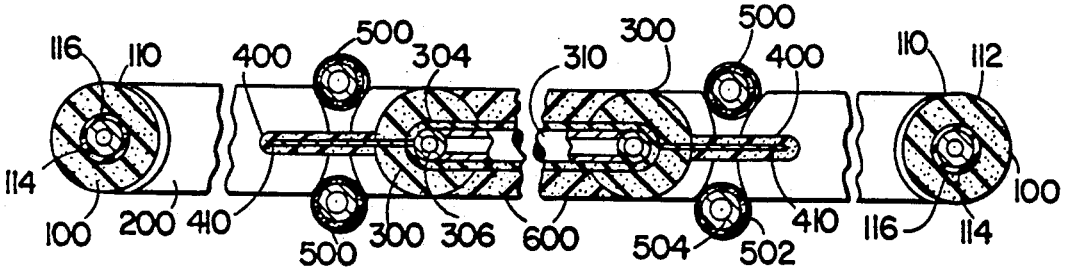
FIG. 4 is an enlarged sectional view partially broken away taken along line 4—4 of FIG. 3.
Figure 5:
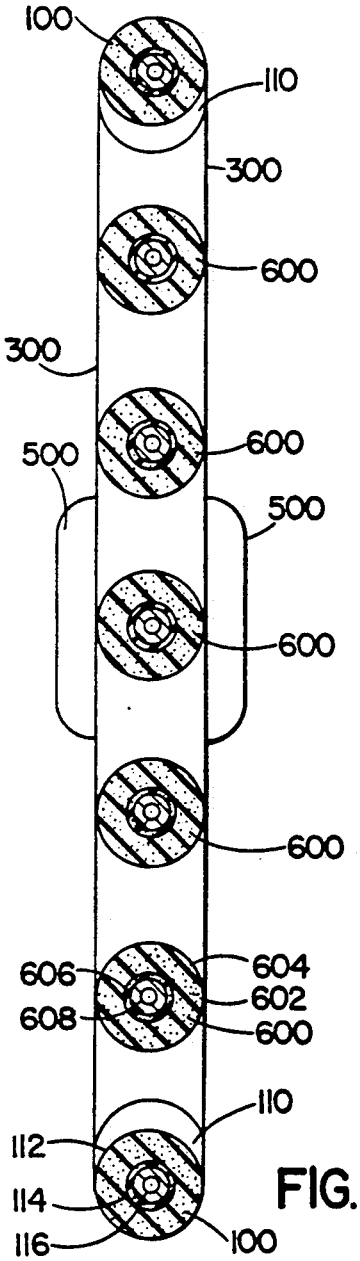
FIG. 5 is an elongated sectional view taken along line 5—5 of FIG. 3.

As shown in FIGS. 4 and 5, the peripheral member 100 is generally circular in cross-section and comprises an outer covering 110 of any suitable resilient material, e.g., rubber, vinyl or plastic, an outer layer of foam rubber 112, an inner layer of foam rubber 114, and a hollow tube 116 central core of any suitably strong, light weight, and rugged material. The foam components may be secured to one another with any suitable conventional adhesive (not shown) or other means available.

The outer covering 110 is preferably applied by dipping the device in a liquid form of vinyl, etc., and permitting the covering to properly cure. The outer layer of foam rubber 112 may be of any type, but is preferably of lower density than the inner foam rubber layer 114. These two types of foam rubber are of the polyethylene type used as pipe insulation, and are generally available from the Insulate Co. The hollow tube 116 central core is preferably comprised of any high grade, light-weight tubing used in automobile racing cars, such as the aluminum tubing commonly known as 6061 T-6, having a wall thickness of approximately 0.062 inches. Likewise, the tube may be comprised of a resilient plastic. The materials described in this paragraph are also preferably used in making the first support members 200, the second support members 300 and the body engagement ribs 600 as described in further detail below and shown in FIGS. 3 and 5.

Figure 6:
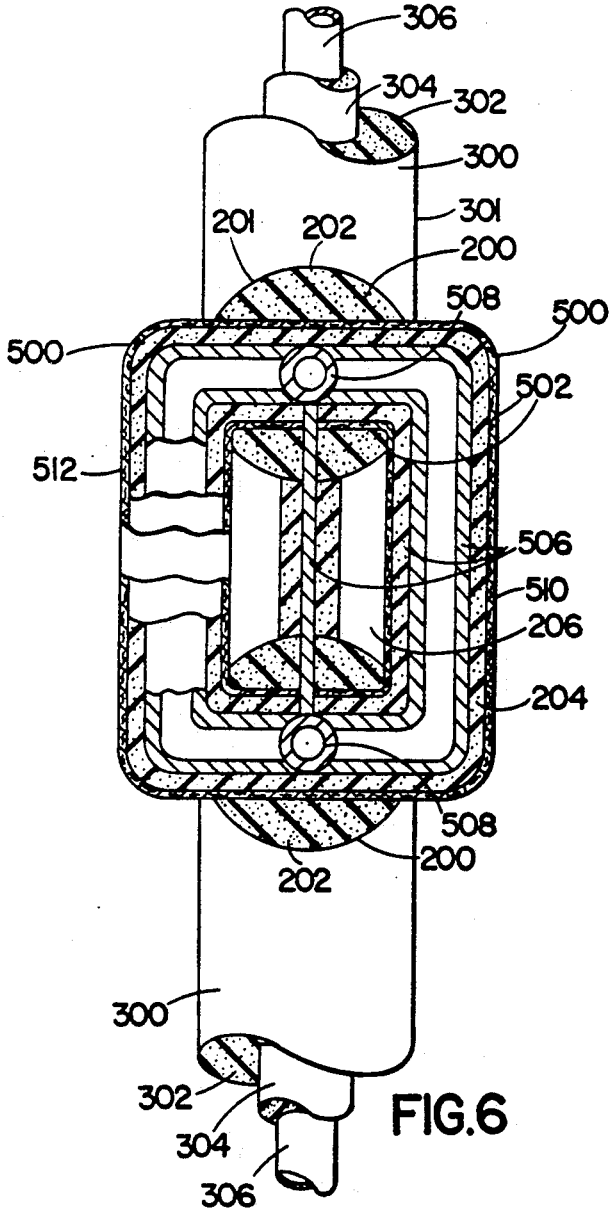
FIG. 6 is an enlarged sectional view partially broken away taken along line 6—6 of FIG. 3.

As shown in greater detail in FIG. 6, each of the members 200 comprises an outer protective layer 201, an outer layer of foam rubber 202, an inner layer of foam rubber 204, and a hollow central core 206. The outer end 208 of each member 200 is fixedly secured to the peripheral member 100. Thus, the central core 206 of member 200 may be secured to the core 116 of the peripheral member 100 by welding, or any other conventional securing means.

As should be appreciated by those skilled in the art, the members 200 need not be oriented horizontally and need not be two in number. Rather, the support members 200 may be oriented diagonally or in any other desired orientation and/or configuration and may be of almost any number depending upon the circumstances of use.

The opposite ends 210 of each of the support members 200 are secured to the generally longitudinal second support members 300 in the same general manner as described with reference to the connection of ends 200 to member 100.

Again, the device of the present invention need not be limited to having latitudinal second support members and those skilled in the art may appreciate that any configuration of second support members may be utilized. As shown more clearly in FIG. 4, the second support members 300 have an outer covering 301, an outer layer of foam rubber 302, an inner layer of foam rubber 304, and a core comprising a central hollow tube 306.

As shown in FIGS. 4–5, the separator plates 400 serve to secure the handles 500 to the device 20 and to separate the hands of the two opposing users 22 and 24 from touching during use of the device. The handles are shown clearly in FIGS. 3–6 and are basically comprised of two sections 510 and 512. Preferably the assembled handles 500 are generally rectangular in shape, although a curved or other shaped handle would function equally as well. The handles 500 comprise an outer protective layer 502, an inner layer of foam rubber 504 and a core comprised of a hollow tube 506 made from plastic, or a metal such as aluminum. The sections 510 and 512 are secured to first support members 200 and separator plates 400. The outer protective layer 502 may be comprised of any suitable material, but is preferably comprised of a cloth-type gripping tape generally used on bicycle handles.

The upper end 310 of each of the members 300 is fixedly secured to the peripheral member 100. Similarly the lower end 312 of each of the members 300 is fixedly secured to the peripheral member 100. Such connections are achieved in the same manner as described with reference to the connection of members 200 to member 100.

As shown in FIG. 4, the separator plates 400 serve to secure the handles 500 to the device 20 and to separate the hand of the two opposing users 22 and 24 from touching during use of the device. The handles are shown clearly in FIGS. 3–6 and basically comprise a central core 506 covered by a layer of foam rubber 504. The central core 506 may be made of plastic or a metal such as 6061 T-6 ⅛ inch aluminum and is secured to the hollow tubes 306 of each of the second support members 30 by welding or other means. As shown in FIG. 5, the separator plates are secured between each piece of the two piece handles 500.

The latitudinal support members 300 provide support for the generally horizontal body engagement ribs 600. Thus, the outer end 602 of each rib is fixedly secured to an associated longitudinal support member 300 in the same manner as the support members 300 are secured to the peripheral member 100.

The body engagement ribs 600 need not be disposed horizontally. Moreover, they need not be linear, e.g., may be curved. However, the device is most easily and inexpensively manufactured when straight ribs 600 are utilized. Further, while the device is shown with five body engagement ribs, it should be readily apparent that almost any number may be used depending upon the circumstances and the ribs need not be spaced equally apart as shown. It is preferable however, that the spacing between each rib be sufficiently small to preclude a player's head from passing through the shield, whereupon it may be injured by impacting the person on the other side of the device. To that end, it is preferred that the rib spacing be approximately 4–5 inches.

The ribs 600, like the other members, 100, 200 and 300 preferentially comprise an outer protective layer 602, an outer layer of foam rubber 604, an inner layer of foam rubber 606 and an inner core comprised of a hollow tube 608 made from a resilient plastic or a metal such as aluminum.

Two players may use the device of the present invention by each grasping a pair of handles on opposing sides. The players then bring each of their bodies into engagement with the barrier wall portion and can exert force against one another to push their opponent beyond a predetermined goal thereby permitting them to practice their blocking and rushing skills. A single player may also use the device to practice agility and running skills by running with the device at various angles and in a variety of directions.

The device of the present invention may also be used to play a game of skill with one or more players. By two players grasping the handles of the device, the players may attempt to maneuver each other about or towards a predetermined goal until a "winner" is determined. A single player may also play a game by timing and comparing his or her performance with the device through a maze with that of other players or previous timings.

One or more persons may also use the device for exercise by taking advantage of any aerobic type exercise while grasping the device. Simultaneous running, with a fast paced arm movement, provides the user with cardiac conditioning, while increasing their rate of caloric consumption.

As a diagnostic tool, the exercise shield enables a coach/trainer or an individual player to diagnose certain elements of the player's blocking/pass rushing proficiencies and/or weaknesses. By one or two players grasping the device, and moving or running in opposition to one another with the device between them, a coach may determine a player's abilities such as leg strength, speed, balance and coordination, along with arm strength and overall body power, as well as those related to technique.

Without further elaboration, the foregoing will so fully illustrate my invention that others may, by applying current or future knowledge, readily adapt the same for use under various conditions of service.

I claim:

1. An exercise shield device to be used by at least one person comprising a barrier wall means having a pair of opposed gripping means, said barrier wall means comprising a peripheral member and interconnected spaced-apart members, said interconnected spaced-apart members comprising a first support means, a second support means, and a plurality of spaced-apart body engagement ribs, said first and second support means having ends, said peripheral member being fixedly secured to said ends of said first and said second support means, said gripping means being supported by said first support means, and said plurality of body engagement ribs supported by said second support means, all of which are somewhat cushioned.

2. The device of claim 1 wherein said first support means are generally perpendicular to said second support means.

3. The device of claim 1 wherein said peripheral member, said plurality of body engagement ribs and said first and said second support means have cross sections which are generally cylindrical in shape, and comprise a hollow tube cushioned by a resilient material.

4. The device of claim 3 wherein said resilient material for cushioning comprises an inner and an outer cylindrical layer of foam rubber, said outer layer of foam rubber being less dense than said inner cylindrical layer of foam rubber.

5. The device of claim 3 wherein said hollow tube comprises substantially rigid rubber.

6. The device of claim 3 wherein said hollow tube comprises metal.

7. The device of claim 6 wherein said metal is aluminum.

8. The device of claim 1 wherein said gripping means comprises a separator plate, and a handle comprising a first and a second piece, said separator plate being fixedly secured between said first and said second piece, and said first and second piece being fixedly secured to said first support means.

9. The device of claim 8 wherein said handle is generally rectangular in shape and comprises a hollow tube covered by a substantially rigid material.

10. The device of claim 9 wherein said substantially rigid material comprises an inner layer of foam rubber and an outer layer of a substantially resilient material.

11. The device of claim 10 wherein said substantially resilient material comprises plastic.

12. The device of claim 9 wherein said hollow tube comprises substantially rigid rubber.

13. The device of claim 9 wherein said hollow tube comprises metal.

14. The device of claim 8 wherein said separator plate comprises a substantially rigid material.

15. The device of claim 14 wherein said substantially rigid material of said separator plate comprises plastic.

16. The device of claim 14 wherein said substantially rigid material of said separator plate comprises rubber.

17. The device of claim 1 wherein said plurality of body engagement ribs are substantially perpendicular to said second support means.

18. The device of claim 17 wherein said plurality of body engagement ribs are spaced sufficiently close together to prevent the head of said at least one person from passing through the space between said body engagement ribs.

19. The device of claim 17 wherein said plurality of body engagement ribs are spaced apart in the range of 4 to 5 inches.

20. The device of claim 3 wherein said peripheral member is generally elliptical in shape.

* * * * *